United States Patent [19]

Fritz, Jr.

[11] 4,308,916

[45] Jan. 5, 1982

[54] PITLESS CONNECTION INCORPORATING PRESSURE RELIEF VALVE

[76] Inventor: Richard R. Fritz, Jr., P.O. Box 903, Verdi, Nev. 89439

[21] Appl. No.: 90,739

[22] Filed: Nov. 2, 1979

[51] Int. Cl.[3] ..... E21B 33/10; E21B 34/08

[52] U.S. Cl. ..... 166/86; 166/85; 166/88; 166/325

[58] Field of Search ..... 166/85, 88, 95, 325, 166/86; 137/115

[56] References Cited

U.S. PATENT DOCUMENTS

| | | | |
|---|---|---|---|
| 1,536,348 | 5/1925 | Mack | 166/325 X |
| 1,586,992 | 6/1926 | Hessemer | 166/95 |
| 2,252,773 | 8/1941 | Lageson | 166/88 |
| 2,917,113 | 12/1959 | Ortman | 166/88 X |
| 2,954,742 | 10/1960 | Williams | 166/86 X |
| 2,960,166 | 11/1960 | Haydin et al. | 166/88 X |
| 3,095,929 | 7/1963 | McGuire et al. | 166/88 X |
| 3,306,358 | 2/1967 | Williams | 166/89 |
| 3,334,697 | 8/1967 | Edwards et al. | 166/325 X |
| 3,467,181 | 9/1969 | Maass | 166/85 |
| 3,976,131 | 8/1976 | Woodford et al. | 166/88 X |

*Primary Examiner*—James A. Leppink
*Assistant Examiner*—George A. Suchfield
*Attorney, Agent, or Firm*—Herbert C. Schulze

[57] ABSTRACT

This invention is a pitless water well adapter which incorporates a pressure relief valve in such manner that in the event the pressure relief valve is activated it discharges directly back into the well and down the well casing rather than exterior in a different part of the system as has been customary. The invention is characterized by a pitless adapter wherein the pitless adapter has been modified so as to incorporate a pressure relief valve having an opening from which water will discharge directly within the well casing.

1 Claim, 8 Drawing Figures

Fig. 6.
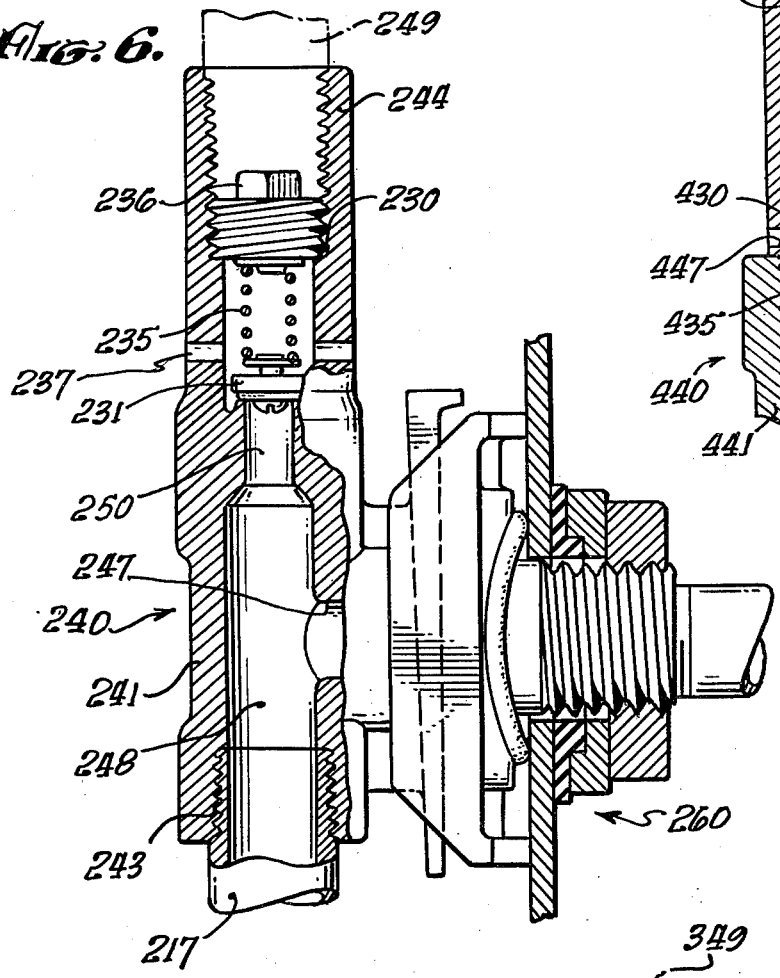
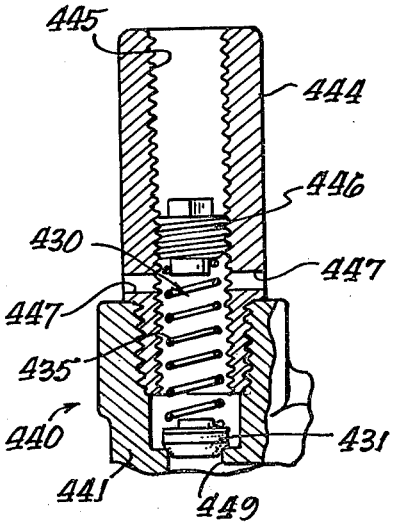
Fig. 8.
Fig. 7.
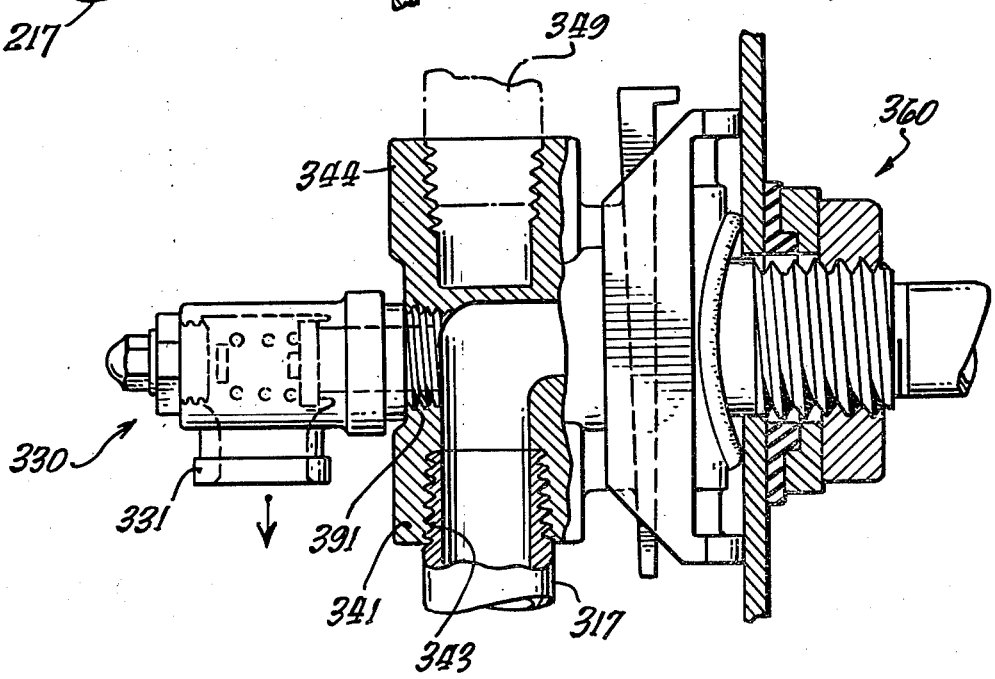

PITLESS CONNECTION INCORPORATING PRESSURE RELIEF VALVE

BACKGROUND OF THE INVENTION

1. Field of the Invention

This invention is in the general field of water well supply systems and is more particularly related to water wells incorporating a well known pitless adapter arrangement for domestic water supply and is even more particularly related to and directed to a pitless adapter for use within a water well wherein the pitless adapter incorporates a pressure relief valve means thus eliminating exterior pressure relief valves from the domestic water system.

2. Description of the Prior Art

Pitless well adapters have been known and used for many years. The pitless well adapter is a device which permits water to be drawn upwardly in a pipe within the well casing, and into the pitless adapter which then connects to an opening through the casing from which the water is removed from the well, normally into a domestic system utilizing a pressure pump, or the like.

There have been many different types of pitless well adapters which are known to those skilled in the art, but the pressure relief valve which is important for protection of the domestic system exterior of the well has never been provided in a usable combination with, and as a part of, the pitless adapter. In this respect, there is no prior art to this invention.

SUMMARY OF THE INVENTION

Pitless well adapters are commonly used in great quantities for supplying domestic water from a domestic water well wherein a pump is located within the casing and within the well and is connected to a discharge pipe which runs upwardly through the well casing to a point near the surface at which point an opening is provided in the casing and an apparatus called a "pitless adapter" is utilized to connect from the pipe in the interior of the well to the exterior of the well and thus to a domestic water supply.

The domestic water supply customarily will embody a pressure tank and a pressure arrangement to supply sufficient water pressure for domestic use whether this be in a home or some other type use. In order to protect the system against excessive pressure, however, a pressure relief valve must be incorporated someplace within the system and it is customary to provide the pressure relief valve within a basement or the like, and utilize a discharge pipe traveling to the exterior of the building for the discharge in the event the pressure relief valve is activated by excessive pressure in the system.

Such a system is expensive and also requires some exterior arrangement for accommodating water which may result from excessive pressure and the activation of the pressure relief valve. The cost is large, the plumbing is more complex, and the building must frequently be provided with an unsightly drain and frequently holes or the like must be drilled through foundation areas or the like, in order to reach the exterior of the building.

I have studied this problem, and after a complete review I have found that the pressure conditions, when they exist, exist uniformly throughout the system and the same pressure conditions exist at the pitless adapter as elsewhere in the overall water supply.

I have discovered that I am able to incorporate a pressure relief valve within the pitless adapter and eliminate a great deal of cost at the same time accomplishing the same protection as has been previously provided by other methods as described.

The result of my invention is a great saving in cost, elimination of unsightly exterior drain areas, and actual improved safety.

In accomplishing this, I have found that I can modify existing pitless adapters by the installation of specially constructed pressure relief valves or even in such a manner as to accommodate customary pressure relief valves. In its most desired form, however, I have been able to build a pressure relief valve into a pitless adapter without destroying or interfering with all of the other uses and conveniences of the pitless adapter.

It is an object of this invention to provide a pressure relief valve incorporated into and cooperative with a pitless adapter.

Another object of this invention is to provide a pitless adapter as described which will incorporate a pressure relief valve which will discharge any water resulting from activation of the pressure relief valve directly into the well casing.

Another object of this invention is to provide a pitless adapter incorporating a pressure relief valve in such manner that the pressure relief valve can be serviced from the exterior of the well even while still in place within the casing.

The foregoing and other objects and advantages of this invention will become apparent to those skilled in the art upon reading the description of a preferred embodiment which follows in conjunction with a review of the appended drawings.

BRIEF DESCRIPTION OF THE DRAWINGS

FIG. 6 is a partially sectionalized view of the most preferred embodiment of an apparatus of this invention;

FIG. 7 is a partially sectionalized view of another alternate embodiment of an apparatus of this invention; and FIG. 8 is a partially sectionalized view of portion of a customary pitless adapter modified so as to form a still further embodiment of this invention.

DESCRIPTION OF A PREFERRED EMBODIMENT

Figures 1, 2, 3:
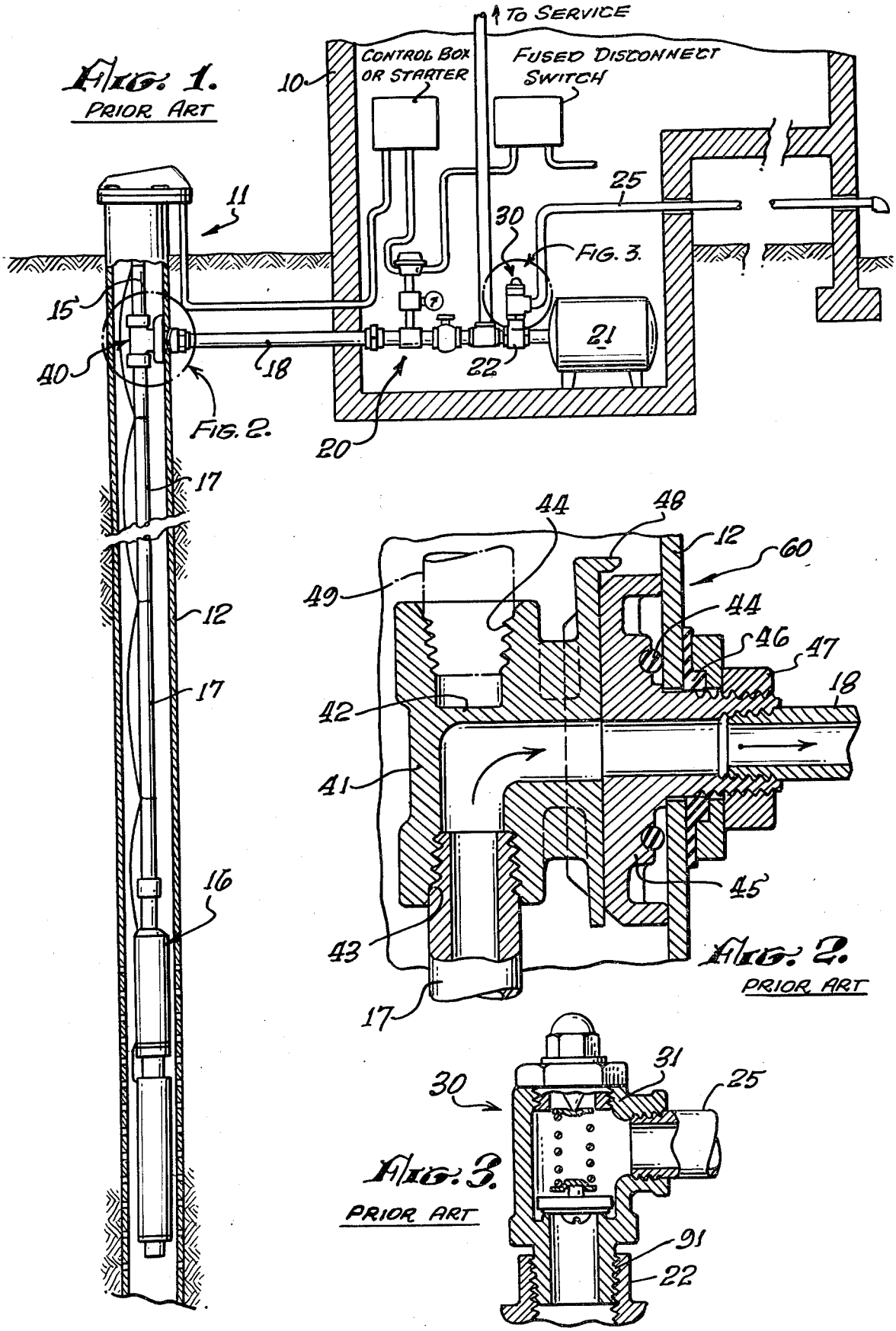
FIG. 1. PRIOR ART
FIG. 2. PRIOR ART
FIG. 3. PRIOR ART
FIG. 1 is a partially sectionalized schematic view of a domestic water well system wherein a pitless adapter is used according to the prior art.
FIG. 2 is an enlarged partially sectioned view of the area of FIG. 2 of FIG. 1.
FIG. 3 is an enlarged partially sectioned view of the area of FIG. 3 of FIG. 1.

FIGS. 1, 2, and 3 illustrate a domestic water supply utilizing a water well wherein a pitless adapter is used. These figures show the art as customarily practiced prior to the present invention.

A building or the like 10 is illustrated schematically as to that portion of the building wherein the water will be received and the pressure system will be utilized. A water well generally 11 is illustrated at a distance from the building. The water well includes a casing 12, pump units 16 below the surface, and a water discharge pipe 17. A pitless adapter generally 40 is utilized to connect through the well casing to pipe 18 which enters the building as shown. The short pipe 15 in the upper portion of the well is utilized to lift or lower the pipe 17, pitless adapter 14, and pumps as may be desired or required for service. This is customary and is known in the art and will be described in somewhat more detail below.

There will generally be within the water supply system a series of apparatus including valves, gauges and the like. A pressure tank 21 is frequently involved and the wiring service is shown.

Generally there will be a connection adjacent the tank 21, which connection will utilize a "T" or the like 22 to which will be connected a pressure relief valve 30 and from the pressure relief valve 30 a drain pipe 25 must be run. In the event of an excessive buildup of pressure, the pressure relief valve will actuate and relieve the pressure by allowing water to flow through pipe 25 to the exterior of the building.

The pitless adapter is shown to embody a body 41 essentially in the shape of a "T" having pipe threads at 43 which will connect to the pipe 17 within the well and pipe threads 44, which will connect to a short piece of pipe 49 which will be used for raising or lowering the entire device in the well as may be required for service. The construction of the pitless adapter is well known to those skilled in the art and need not be further described. For example, the pitless adapter as illustrated will embody interconnecting members as known in the art such that the slide tongue 48 will make an alignment of the conduit with the portion 45 which extends through the well casing. A gasket or the like 44 prevents a flow of water or other material from the exterior of the well to the interior or vice-versa.

The additional gasket 46 further seals the connection. A service pipe 18 is pulled tightly into position through the thread arrangement as indicated and is cinched into position against the gasket by the interconnecting and operative collar 47. All of these matters are known to those skilled in the art. The use of a pitless adapter is further shown in U.S. Pat. No. 3,306,358. In that patent the construction is different for purposes of patentability but the functioning is explained for those who may not be familiar with it.

The web 42 is built into the pitless adapter so as to prevent water from escaping through the top of the pitless adapter.

FIG. 3 illustrates a pressure relief valve of customary construction as is known to those skilled in the art. The discharge pipe 25 is threaded into the pressure relief valve which includes a body 31 connected at threads 19 to the fitting 22. The pressure relief valve customarily will include a spring loaded sealing arrangement as indicated and is known to those skilled in the art.

Figures 4, 5:
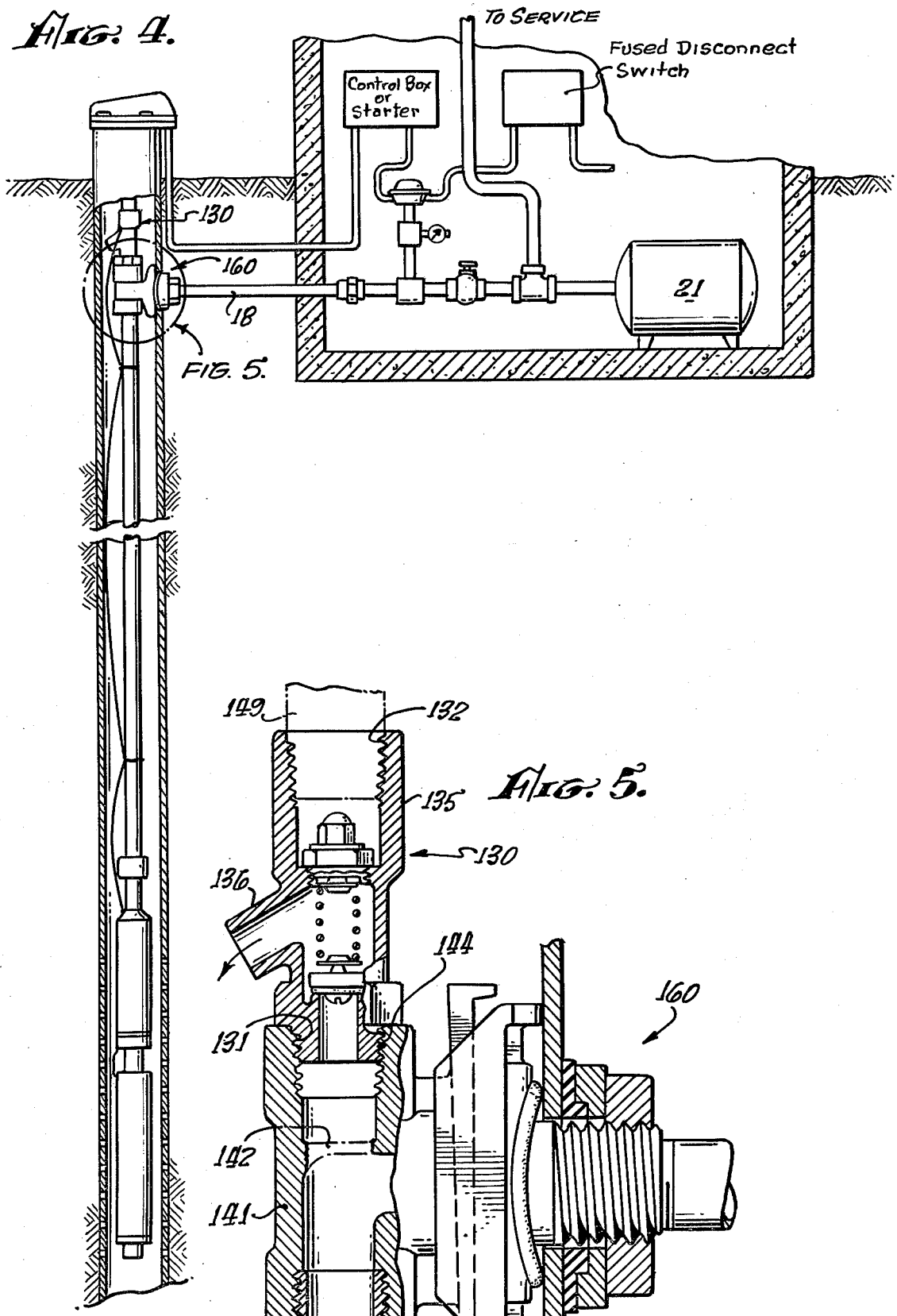
FIG. 4 is a view similar to that of FIG. 1, but showing the installation wherein the apparatus of this invention is being used.
FIG. 5 is an enlarged partially sectionalized view of the area of FIG. 5 on FIG. 4 and incorporating an embodiment of the apparatus of this invention.

FIG. 4 illustrates essentially the same apparatus as FIG. 1, except that it will be noted the connection 22 and the pressure relief valve 30 and discharge line 25 have been eliminated.

Fundamentally, the pitless adapter itself is the same and the details of construction are not shown in FIG. 5. However, the pitless adapter at 160 incorporates the same general features as that previously described as item 60 in the foregoing description of drawings.

In this case it will be seen that the body of the pitless adapter 141 has been provided with threads at 143 interconnecting to well pipe 117. At the upper end the threads 144 accommodate threads 131 on apparatus 130.

Significantly in FIG. 5 it will be noted that the web 142 originally existing in a pitless adapter has been drilled out and where it previously existed is where it is indicated solely by the phantom lines.

The apparatus 130 is seen to incorporate a discharge spout 136, a customary spring loaded sealing device as will be understood by those skilled in the art, and an upper extending end 135 having interior threads 132 adaptable to receive a handling pipe 149 as shown in phantom.

FIG. 6 illustrates the most preferred form of an apparatus to utilize the principles and advantages of this invention. In FIG. 6, the pitless adapter element 240 has been specially formed having the body 241 with opening 248 extending through its length to the area 250 where it is tapered down so as to provide the proper diameter to appropriately accommodate the sealing washer device 231. Opening 247 is the customary opening to provide the water through the pitless adapter to the exterior of the well casing by means of the overall unit 260.

The washer sealing device 231 is held by pressure of the spring 235 which in turn is held by a plug 236 which will be screwed into the threads 244 in order to achieve the desired tension upon the spring.

The threads 244 will also accommodate the threads on handling pipe 249 as desired.

A series of openings 237 will be provided about the circumference of the upper portion of the apparatus 240 from which water will be discharged in the event the pressure relief valve should be activated.

FIG. 7 shows another alternate embodiment wherein a customary pitless adapter is shown connected to the casing in customary manner by the mechanism 260. In this case none of the features have been changed. The body 344 being in its original condition to receive handling pipe 349 and at its lower configuration 341 to receive the well pipe 317 in the threads 343. In this case, a threaded hole has been provided at 391 and a customary pressure relief valve 330 has been threaded into the hole at 391. If activated by excessive pressure the water would discharge through the opening 331.

FIG. 8 illustrates another new embodiment wherein the customary pitless adapter 440 has had a hole drilled at 449 through the flange or webb normally existing in that area. The sealing washer or the like 441 seats upon this hole so as to prevent water flowing through it and is held down by the pressure of spring 435 which is adjustable by means of plug 446 in threads 445 of a pipe having an exterior area suitable to be threaded in the upper end of the pitless adapter as shown.

The body 444 having the interior 445 can still be used for handling of the pitless adapter and everything connected to it by means of a pipe or the like inserted and threaded into the upper portion of the threads 445. The holes 447 about the perimeter of the element 444 will provide for the discharge of water in the event the pressure relief valve should be activated by excessive pressure.

In operation, any of the apparatus shown wherein a pressure relief valve is incorporated with the pitless adapter will operate in a similar manner. When pressure builds up the pressure relief valve will activate as is known by those skilled in the art, but the water will merely discharge into the well within the casing thus preventing discharge to the exterior.

In the embodiments shown in FIGS. 5, 6, and 8, the pressure relief valve can be adjusted or repaired without disturbing the position of the pitless adapter. In such instance, as will be clear, a tool incorporating a socket wrench or the like may be lowered into the pitless adapter from above and the plug which holds the spring in compression may be removed hereafter the other portions may be removed for service.

While the improvement in this pitless adapter as shown may be considered by some persons to be a very simple and almost obvious expedient, I have found that no one considers that until after it is explained to them.

I have discussed the problem of the discharge of water from a pressure relief valve in the prior art with many persons in this field. All have agreed that it is a bad situation, and yet it has never occurred to anyone that a pitless adapter could be utilized for a housing of a pressure relief valve.

In searching the literature and the like, I have found that this is a completely unique and unexpected result by the incorporation of a pressure relief valve at this point.

While the embodiments of this invention shown and described are fully capable of achieving the objects and advantages desired, it is to be understood that such embodiments are for purposes of illustration only and not for purposes of limitation.

I claim:

1. A pitless adapter for a water well comprising a hollow tubular member having interior threads at each end; a passageway interconnecting to the interior of said hollow tubular member through a side wall of said tubular member; a pressure relief valve inserted in the threads at one end of said tubular member; a water pipe inserted in the threads of the other end of said tubular member; connection means connecting said tubular member to the interior of a water well casing; and means interconnecting with the opening through the wall of said tubular member to a water conduit on the exterior of said well casing.

* * * * *